US008490975B2

(12) United States Patent
Jones

(10) Patent No.: US 8,490,975 B2
(45) Date of Patent: Jul. 23, 2013

(54) METHOD FOR PLAYING A GAME SIMILAR TO CRAPS

(75) Inventor: Mark H. Jones, Magalia, CA (US)

(73) Assignee: Mark H. Jones, Minden, NV (US)

( * ) Notice: Subject to any disclaimer, the term of this patent is extended or adjusted under 35 U.S.C. 154(b) by 288 days.

(21) Appl. No.: 12/394,088

(22) Filed: Feb. 27, 2009

(65) Prior Publication Data

US 2009/0250873 A1 Oct. 8, 2009

Related U.S. Application Data

(60) Provisional application No. 61/041,701, filed on Apr. 2, 2008.

(51) Int. Cl.
*A63F 3/08* (2006.01)

(52) U.S. Cl.
USPC ..... 273/274

(58) Field of Classification Search
USPC ..... 273/274
See application file for complete search history.

(56) References Cited

U.S. PATENT DOCUMENTS 5,490,670 A * 2/1996 Hobert ..... 463/20
5,768,382 A * 6/1998 Schneier et al. ..... 380/251
5,829,749 A * 11/1998 Hobert ..... 273/274
6,520,503 B1 2/2003 Porto
6,688,597 B2 2/2004 Jones
6,893,019 B2 * 5/2005 Gaygen ..... 273/274
2008/0073842 A1 3/2008 Jones

* cited by examiner

*Primary Examiner* — Kurt Fernstrom
*Assistant Examiner* — Dolores Collins
(74) *Attorney, Agent, or Firm* — Dickinson Wright PLLC

(57) ABSTRACT

A method for playing a multi-player table game similar to craps includes use of a point generation device capable of randomly selecting one outcome from a group consisting of thirty-seven or thirty-eight possible outcomes. Betting locations similar to the game of craps are provided on a betting surface (12). Twelve common betting locations (22) allow proposition bets based on the sum of two six-sided dice, together with an additional possible outcome comprised of a wild non-die depiction. Player positions (18) are designated about the betting surface (12), with replicas (48) of each player position (18) affixed within each of the twelve common betting locations (22), as well as at respective first (54) and second (56) color bet locations distributed about the betting surface (12). Game play enables a dealer to handle only value cheques. The game method can utilize a variety of point generation devices (14, 14') thereby making the game suitable for many jurisdictions and interesting for players.

20 Claims, 7 Drawing Sheets

10
12
18
18
18

METHOD FOR PLAYING A GAME SIMILAR TO CRAPS

CROSS REFERENCE TO RELATED APPLICATIONS

This application claims priority to Provisional Patent Application No. 61/041,701 which was filed on Apr. 2, 2008.

BACKGROUND OF THE INVENTION

1. Field of the Invention

This invention relates to a multi-player game similar to craps, and more particularly toward a multi-player table or video-based wagering game.

2. Related Art

Craps is a long established game with a colorful history. During World Wars I and II, the game enjoyed resurgence in popularity due to servicemen finding a way to fill idle time. When these same servicemen came home from the war having been exposed to the fast moving game of craps, the casinos were willing and ready for the expansion of the game in their casinos. As this generation began to mature and decrease their visits to the casinos, the popularity of the game saw a noted decrease. During this time, table games took a backseat as casino floor space was increasingly dedicated to slot machine play.

This trend is even now beginning to change, and the industry is starting to see a resurgence of table game popularity. One of the important aspects fueling this increase in demand is attributed to the level of entertainment value expected by customers. Many casino game players consider participating in a live table game like craps to be among the highest of table game excitements.

In part, this resurgence in table game interest can be attributed to the introduction of variations in game play for these traditional games. This, combined with the emergence of a new breed of gamers exposed to internet gaming, has resulted in a global explosion in this field. Several variations in the game of craps can be found in prior art examples, including U.S. Pat. No. 6,688,587 to Jones, issued Feb. 10, 2004, the entire disclosure of which is hereby incorporated. Another example may be found in U.S. Pat. No. 6,520,503 to Porto, issued Feb. 18, 2003. The Porto '503 patent is also incorporated here by reference, and describes a game method that can be characterized as a merger of craps and roulette in the same game using a modified roulette wheel as a point generation device. In Porto, the standard numbers of a roulette wheel are changed to reflect dice numbers, as shown in FIG. 3 of that patent.

A particular shortcoming of prior art craps games like those described above involve the requirement that a player possess both value cheques and non-value color chips to play the entire game. The purchase of chips or tokens is an expensive investment for a casino, in view of the fact that both value cheques and non-value chips must be provided for every table game. Furthermore, a game dealer must handle both value cheques and non-value chips during each round of play, thereby slowing each game. Consequently, not many hands can be played per hour. Alternatively a so-called "Mucker" must be provided to assist the dealer in handling the color, non-value chips required in the prior art method of play. Often, costs associated with labor are the single largest component of overhead costs for the casinos. With the prior art style of play, therefore, the casino labor costs will be higher if they wish to increase the speed of game play.

Furthermore, the risk of mistake or fraud is enhanced due to the use of non-value color chips together with the value cheques. In all, the prior art methods are not conducive to the fast paced game play which is increasingly attractive to the newer breed of game players, and also more profitable for casino operators.

And still further, the so-called "Bottom Half" math of the prior art games such as that described by Porto is deficient and not attractive to casinos. For example, according to Porto, players are given a 100% return on the numbers 5 and 9 and an 83.333% return on the 7. These are referred to as a player's negative expectation of zero on the 5 and 9, and a negative expectation of 16.667% on the number 7. A knowledgeable player is likely to appreciate this disparity and bet the 5 and 9 on the Bottom Half math. Consequently, a commercial gaming company is unlikely to place a game like that described by Porto on their playing floor due to the lack of a sufficient house edge. The odds bet on a craps game is the only even odds in a casino. This is allowed on a traditional craps game because a player must place another bet before being allowed to make the odds wager.

And further still, it is important to note that in the game method described in the Porto patent, if a player achieves a 7, they push all color bets. This is considered a shortcoming for reasons that will be described subsequently.

Accordingly, there is a need for an improved method for playing a table game which will be familiar to players yet at the same time include intriguing and novel elements of play, and which enables faster mucking and more hands per hour than traditional games of craps. The proposed game should be sufficiently distinct from traditional games that new levels of excitement and interest are generated without being so different from familiar game methods that players are confused or not intrigued at first impression.

SUMMARY OF THE INVENTION

The invention describes a method for playing a multi-player table game similar to craps. The method comprises the steps of providing a betting surface and designating a plurality of player positions about the betting surface. Each player position bears a distinctive player indicia. Twelve common betting locations are prescribed on the betting surface. Replicas of each player indicia are affixed within the boundaries of each common betting location. A point generation device is provided to randomly select one outcome from a group consisting of thirty-seven or thirty-eight possible outcomes. The thirty-seven or thirty-eight possible outcomes are associated with the twelve common betting locations according to the following arrangement:

At least one outcome is associated with a first of the twelve common betting locations, One outcome is associated with a second of the twelve common betting locations, Two outcomes are associated with a third of the twelve common betting locations, Three outcomes are associated with a fourth of the twelve common betting locations, Four outcomes are associated with a fifth of the twelve common betting locations, Five outcomes are associated with a sixth of the twelve common betting locations, Six outcomes are associated with a seventh of the twelve common betting locations, Five outcomes are associated with an eighth of the twelve common betting locations, Four outcomes are associated with a ninth of the twelve common betting locations, Three outcomes are associated with a tenth of the twelve common betting locations, Two outcomes are associated with an eleventh of the twelve common betting locations, and One outcome is associated with a twelfth of the twelve common betting locations.

A table game operated in the manner described above represents an improvement over known methods for playing games similar to craps. This game method is both familiar and at the same time new and interesting in that new betting options and strategy options are made available to the players. Furthermore, the game method enables non-value color chips to be eliminated so that game dealers will handle only value cheques. This saves the casino from investing in non-value chips. By eliminating the non-value color chips, quicker payout, faster mucking and more hands per hour can be achieved. A single dealer is thus enabled to manage the affairs of game play, without the need for a Mucking assistant. Therefore, labor costs associated with play of the subject game are lower than in prior art methods. Furthermore, the risk of mistake or fraud is further reduced by the elimination of non-value color chips. By affixing replicas of each player indicia within the boundaries of each common betting location, player bets can be identified by value cheques irrespective of color. Rather, player bets are coordinated by their association with the player indicia which is replicated within each of the twelve common betting areas. This enables the game dealer to render more accurate paybacks with less likelihood of mistake or fraud.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
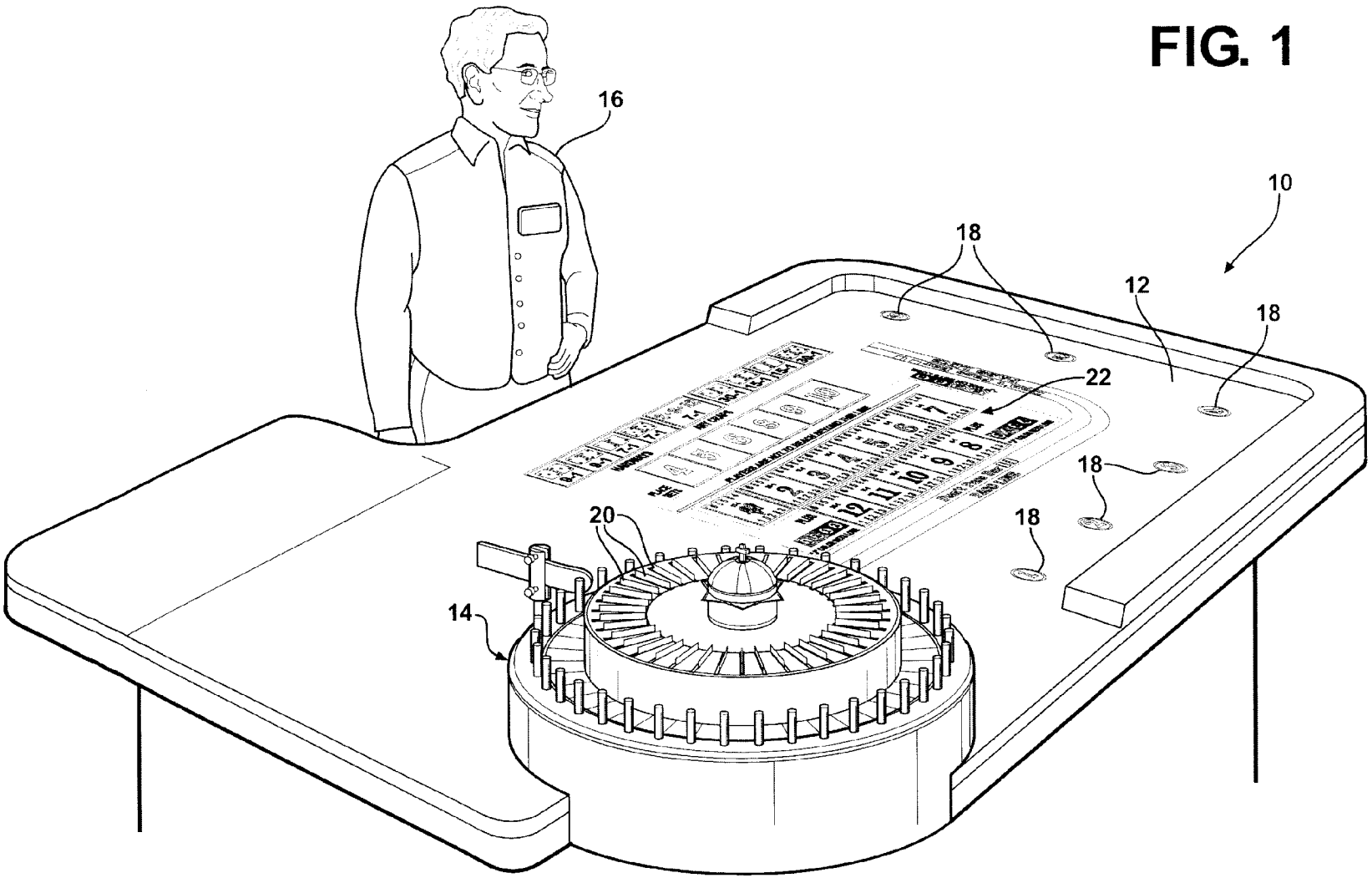
FIG. 1 is a perspective view of a game method according to the subject invention and utilizing a card wheel as a point generation device.
Figure 2:
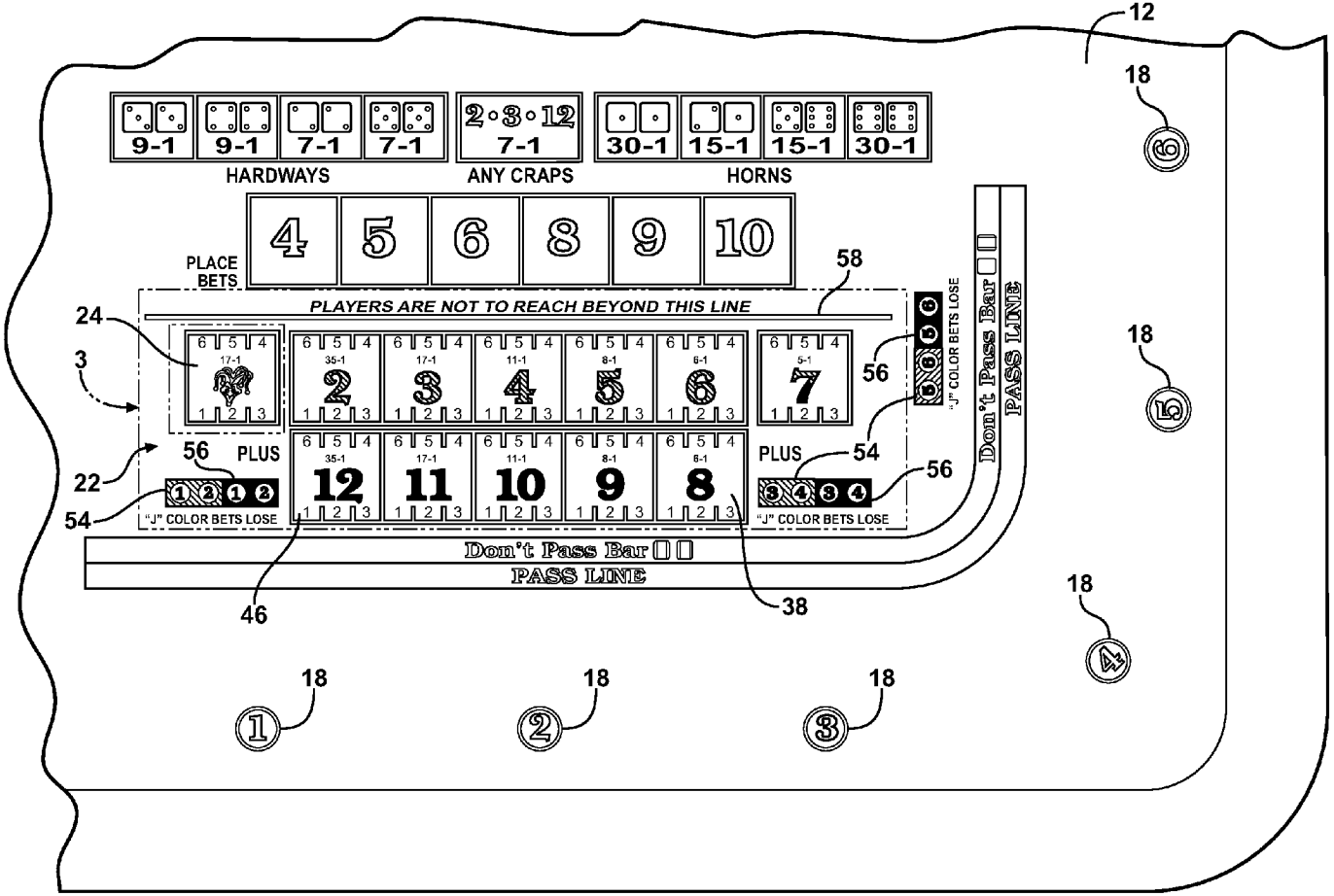
FIG. 2 is an enlarged view of the betting surface of a game operated according to the subject rules.
Figure 3:
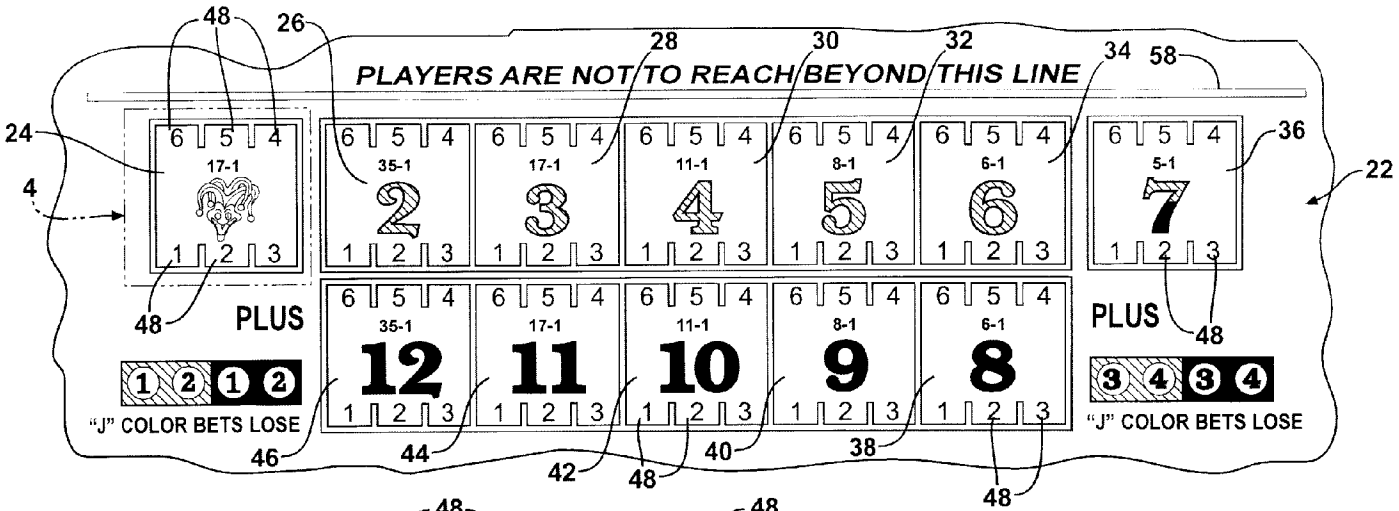
FIG. 3 is an enlarged view of the betting area prescribed by broken lines and indicated at 3 in FIG. 2.
Figure 4:
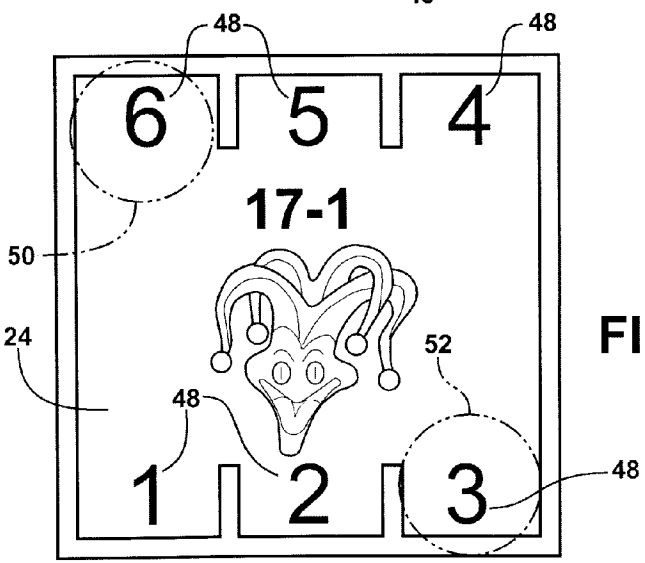
FIG. 4 is an enlarged view of the betting area circumscribed by broken lines and indicated at 4 in FIG. 3.

Referring to the Figures, wherein like numerals indicate like or corresponding parts throughout the several views, a table for playing a multi-player game similar to craps is generally shown at 10. The table 10 provides a generally horizontal betting surface 12 which is traditionally established by a felt covering, but may be any suitable surface or even a virtual representation of a playing surface displayed on a graphic user interface. A point generation device, generally indicated at 14, is associated with the table 10 so that a dealer 16 or table game operator can actuate the point generation device 14 and manage game play occurring over the betting surface 12. A plurality of player positions 18 are comfortably spaced about the betting surface 12 so that players can stand or sit side-by-side without disturbing the next adjacent player. The player positions 18 are distinguished one from another by distinctive player indicia which, in the preferred embodiment, includes the display of numbers arranged sequentially beginning with the number "1". Thus, in the examples shown, six player positions 18 are provided, designated by the numbers 1, 2, 3, 4, 5 and 6.

The point generation device 14 may be of the card wheel variety such as that described in the applicant's copending application US 2008/0073842, the entire disclosure of which is hereby incorporated by reference. In this configuration, the point generation device 14 has a turntable configuration supported for free rotation about a vertical axis. A plurality of trays extend radially from the central axis and are sized, shaped and oriented so as to hold a single playing card 20 in a generally upstanding orientation. The cards 20 may be dimensionally similar to those used for playing card games like poker, blackjack and the like, although other shapes are certainly possible. Either thirty-seven or thirty-eight trays are formed in the point generation device 14 so as to hold either thirty-seven or thirty-eight individual cards 20. In the example of thirty-seven trays, each tray occupies a sector of approximately 9.73°. In the example of a thirty-eight tray configuration, each tray occupies a sector of approximately 9.47°. The game play method of the subject invention requires the point generation device 14 to be capable of randomly selecting one outcome from a group consisting of thirty-seven or thirty-eight possible outcomes. Thus, by affixing a different graphic depiction on each playing card 20, the thirty-seven or thirty-eight possible outcomes can be achieved by use of the card wheel style point generation device 14. When the card wheel is spun, it eventually comes to rest in a manner that singulates a particular one of the playing cards 20 from among the thirty-seven or thirty-eight possible playing cards 20.

Figure 8:
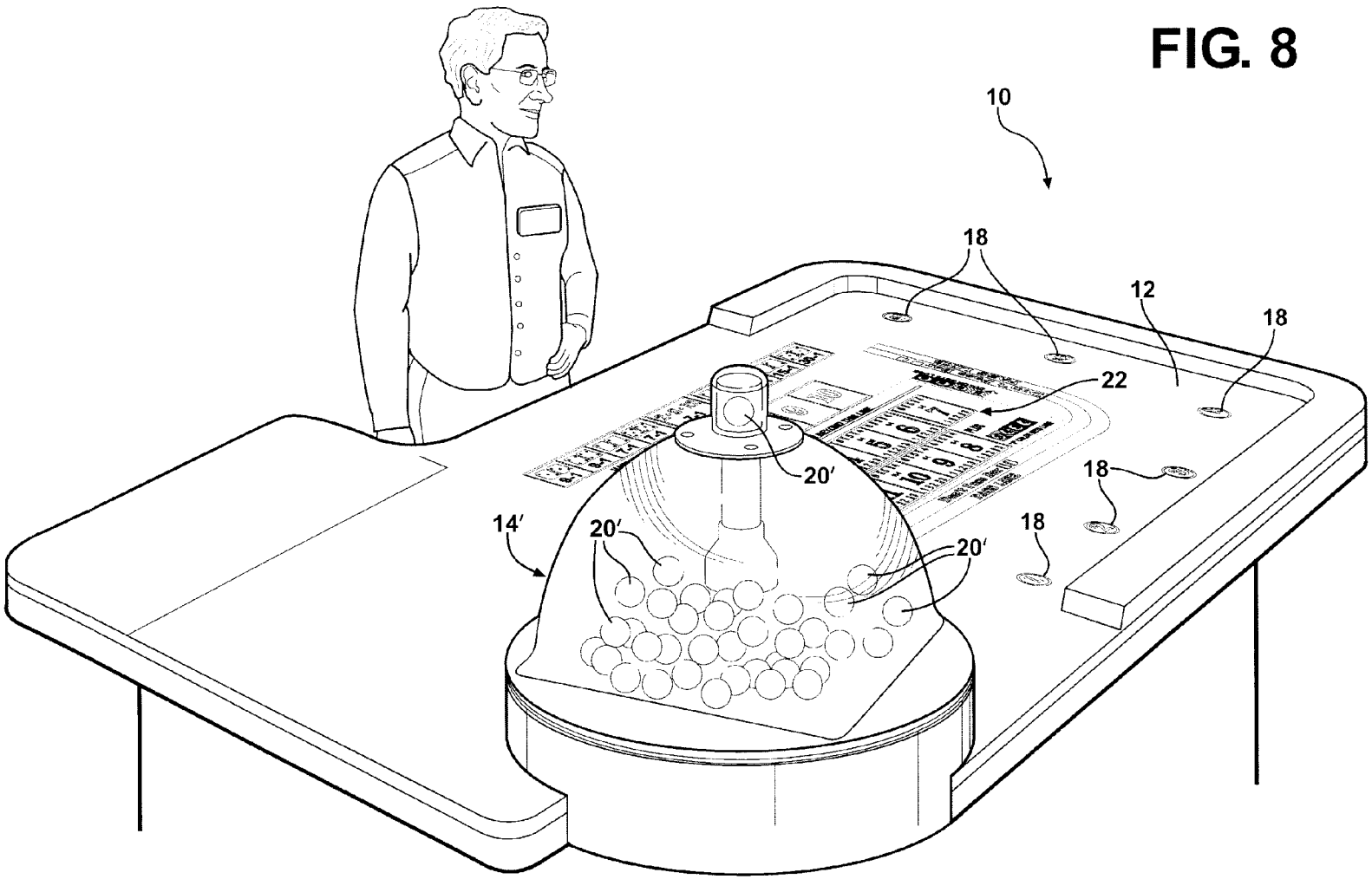
FIG. 8 is a view as in FIG. 1, but showing a ball blower mixing machine as a point generation device.

Of course, those of skill in the art will readily envision alternative point generation devices which may be used instead of the card wheel style device 14. For one example, FIG. 8 illustrates an alternative point generation device 14' of the ball blower/ball mixing variety common in keno and lottery games, wherein a plurality of balls 20' serve the function of playing cards 20 in the preceding example. A group consisting of thirty-seven or thirty-eight balls 20' is imprinted with respective indicia representative of thirty-seven or thirty-eight different possible outcomes. Because the game method of the subject invention is played in single draw style, multiple groups of balls 20' can be loaded into the point generation device 14' without altering the game odds. Similarly, other point generation devices can also be implemented, including random number generators, a single card shuffler operating on groups of playing cards, two separate card shufflers each with seven cards, computer generated representations of these, and other suitable methods.

Referring now to FIGS. 2 through 5, the betting surface 12 is shown in greater detail. Twelve common betting locations, generally indicated at 22, are prescribed on the betting surface 12. A first 24 one of the twelve common betting locations 22 is shown bearing the image of a Joker which is chosen here as an example of a wild non-die depiction. A second 26 one of the common betting locations depicts the number "2". A third 28 common betting location bears the indicia "3". A fourth 30 common betting location displays the number "4". A fifth 32 common betting location displays the number "5". The sixth 34 common betting location bears the number "6". The seventh 36 common betting location depicts the number "7". The eighth 38 betting location bears the number "8". The ninth 40 common betting location shows the number "9". The tenth 42 common betting location contains the number "10". The eleventh 44 common betting location shows the number "11". The twelfth 46 common betting location includes the number "12". The numbers 2-12 correspond to the sum of numbers which can be achieved by rolling two six-sided die. In other words, if a standard cube-like die represents at least one and no more than six non-repeating dots on its six sides, two such dice rolled together can be summed to achieve a number between two and twelve. These numbers are represented by the characters in the second 26 through twelfth 46 betting locations. The first common betting location 24 bearing the Joker depiction may comprise any symbol but not the numbers "2" through "12". Thus, the Joker symbol in the first betting location 24 symbolizes a possible outcome from the point generation device 14 which cannot otherwise be equated to the sum of dots depicted on two six-sided die. Alternative symbols to the Joker image in the first betting location 24 can include the symbols "0", "00", a company logo, or the like.

Replicas 48 of each player indicia 18 are affixed within the boundaries of each common betting location 22. Thus, as perhaps best shown in FIG. 4, which relates to the first common betting location 24 containing the Joker symbol, replicas 48 associated with player positions 1 through 6 have been laid out. Broken circle 50 represents a betting token, such as a value cheque associated with player number 6. This token 50 represents a bet placed by a player associated with playing position number 6 and that has placed a bet on the Joker proposition. Likewise, broken circle 52 represents a token placed on the same Joker proposition by a player associated with player position number 3. Again, token 52 represents a value cheque and is an example of how two players can place tokens 50, 52 on the same common betting location and the dealer is able to discern the respective bets without reliance upon the use of color.

Figure 6:
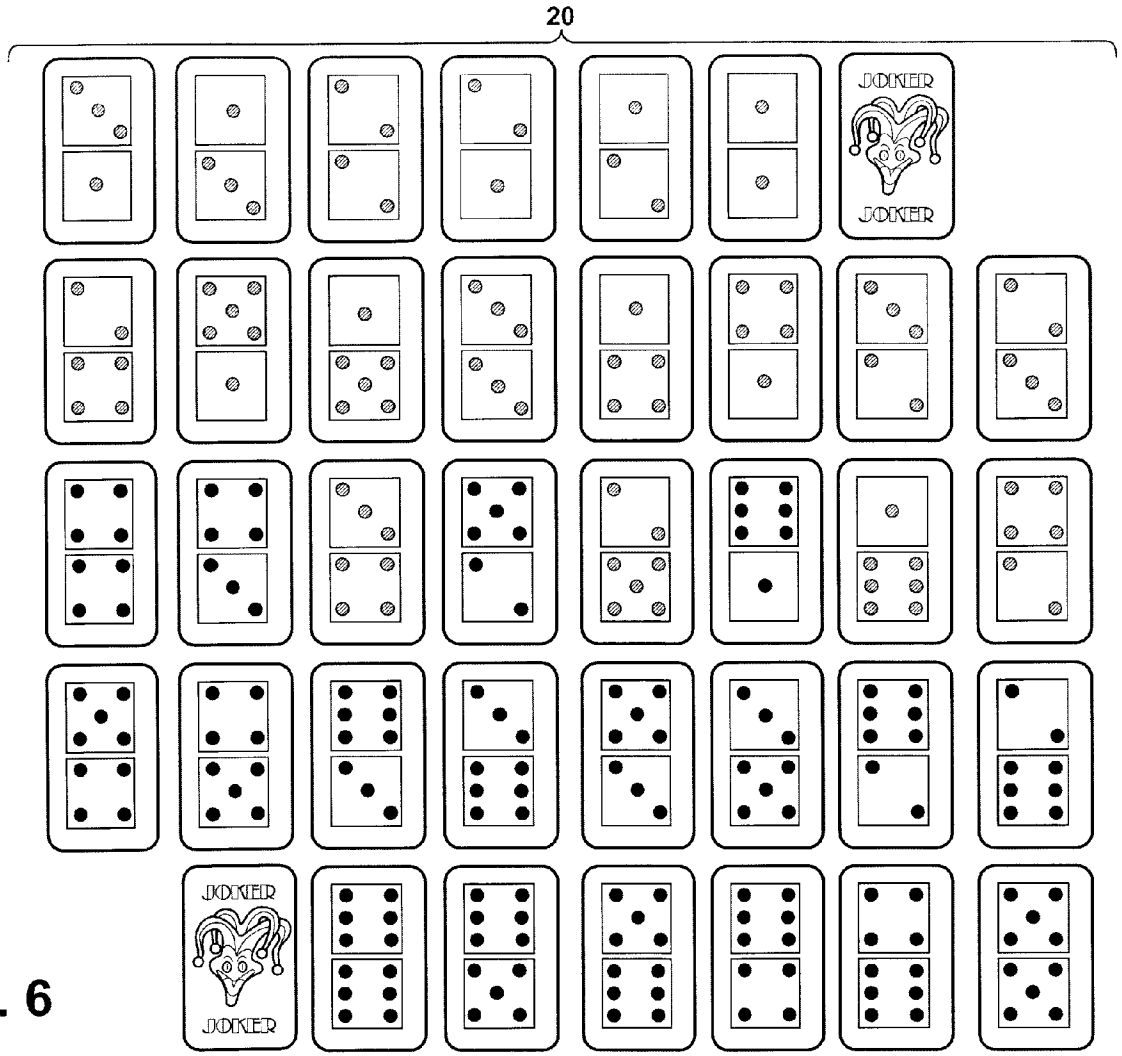
FIG. 6 is an exemplary representation of thirty-eight playing cards of the type used in a card wheel type point generation device and representing possible outcomes.

Referring now to FIG. 6, playing cards 20 are shown of the type used in a point generation device 14 like that described above in connection with FIG. 1. Thirty-eight cards 20 are shown in FIG. 6 and intended for use in a point generation device having exactly thirty-eight possible outcomes. In an alternative embodiment of this invention, thirty-seven playing cards 20 may be utilized in connection with a point generation device 14 which has only thirty-seven possible outcomes. Otherwise, play of the game method is identical, and the difference between thirty-seven or thirty-eight possible outcomes affects only the odds of the game. As shown in FIG. 6, thirty-six of the thirty-eight cards 20 include graphic depictions of each possible combination resulting from the roll of two traditional six-sided dice, where each die represents at least one and no more than six non-repeating dots on its respective sides. The remaining two cards 20 depict the wild non-die depiction of the Joker. The sum of dots on each of the graphical representations is correlated by reference number to the common betting locations 22. When arranged in this fashion, it can be seen that at least one outcome (Jokers) is associated with the first common betting location 24, one outcome (dice sum "2") is associated with the second common betting location 26, two outcomes (dice sum "3") are associated with the third common betting location 28, three outcomes (dice sum "4") are associated with the fourth common betting location 30, four outcomes (dice sum "5") are associated with the fifth common betting location 32, five outcomes (dice sum "6") are associated with the sixth common betting location 34, six outcomes (dice sum "7") are associated with the seventh common betting location 36, five outcomes (dice sum "8") are associated with the eight common betting location 38, four outcomes (dice sum "9") are associated with the ninth common betting location 40, three outcomes (dice sum "10") are associated with the tenth common betting location 42, two outcomes (dice sum "11") are associated with the eleventh common betting location 44, and one outcome (dice sum "12") is associated with the twelfth common betting location 46.

Furthermore, it is desirable to exclusively correlate eighteen of the possible outcomes to a first color, exclusively correlate a different eighteen possible outcomes with a second color, and correlate the remaining one or two outcomes (depending upon whether there are thirty-seven or thirty-eight possible outcomes total) with neither the first color nor the second color. The first and second colors can be any two distinctive colors, but in the preferred embodiment are represented by the colors red and black, with red being designated the first color and black being designated the second color. The colors are imprinted on each of the cards 20 as shown in FIG. 6. The two cards 20 associated with Joker symbols are neither red nor black. In this example, the outcomes associated with the second 26, third 28, fourth 30, fifth 32 and sixth 34 betting locations relate exclusively to the first color red. Conversely, outcomes associated with the eighth 38, ninth 40, tenth 42, eleventh 44 and twelfth 46 betting locations are exclusively related to the second color black. Outcomes associated with the seventh betting location 36 are preferably half red and half black. In other words, of the six occurrences of the outcome associated with dice sum "7", three are correlated with the color red and the other three are correlated with the color black. And, as stated previously, the playing cards 20 associated with the Joker symbol are neither red nor black. Thus, in cases where only one wild non-die depiction is used, only that card will be neither red nor black. However, when two wild non-die depictions are used, both are neither red nor black.

Referring again to FIGS. 2-4, a betting surface 12 is configured to display a first color bet location 54 and a second color bet location 56 for each player position. Thus, in an example where six distinct player positions 18 have been arranged around the betting surface 12, there will be six first color bet locations 54 and six second color bet locations 56. The first color bet locations 54 are associated with the first color which, in this example, is red. Similarly, the second bet locations 56 are related to the color black. These first and second color bet locations 54, 56 provide the player with additional betting options similar, in some respects, to the game of roulette where propositions can be made on the color of a particular outcome. However, because the wild non-die depiction outcomes are neither red nor black, proposition bets made against locations 54 or 56 will lose when the card 20 bearing the Joker symbol is selected by the point generation device 14.

Figure 5:
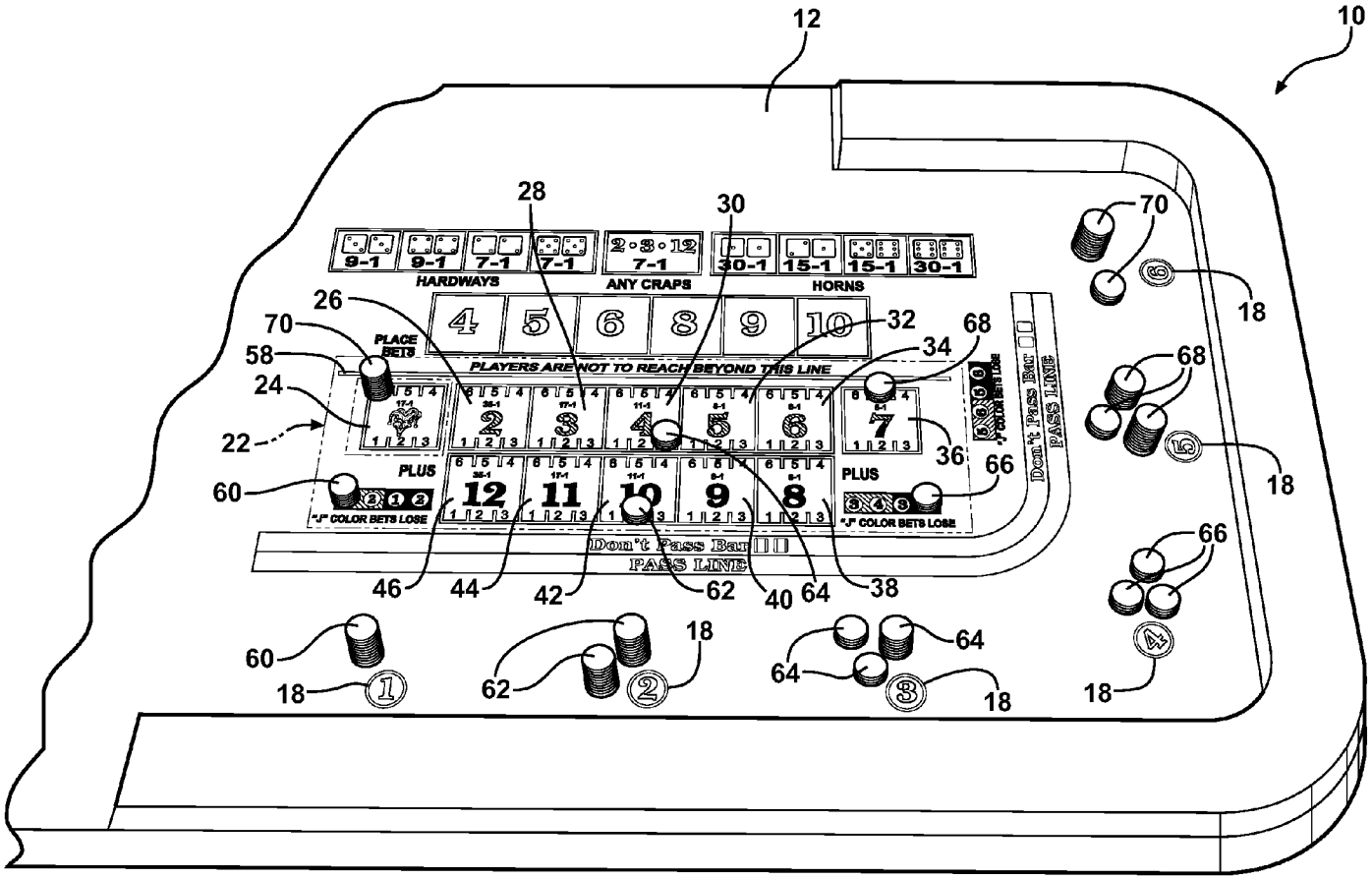
FIG. 5 is a simplified perspective view depicting value cheques associated with player positions 1-6, together with bets placed on the betting surface and attributable to each player.

Turning now to FIG. 5, a method for playing the game of this invention is described in greater detail. As will be appreciated by those of skill in this field, the method of this invention contemplates a single dealer craps-style game where a player can play true odds craps and where the proposition bets on the bottom half of the layout reflect the true math of a one-in thirty-seven number draw or of a one-in thirty-eight number draw depending on the number of possible outcomes provided by the point generation device 14. Accordingly, an exemplary odds table may reflect the following:

| | |
|---|---|
| 2 and 12 pay | 35:1 |
| 3 and 11 pay | 17:1 |
| 4 and 10 pay | 11:1 |
| 5 and 9 pay | 8:1 |
| 6 and 8 pay | 6:1 |
| 7 pays | 5:1 |
| Single Joker pays | 35:1 |
| Double Joker pays | 17:1 |

FIG. 5 represents a sample table layout as described above. A restriction line 58 separates top and bottom portions of the layout which states "players are not to reach beyond this line." Players reaching beyond the restriction line 58 will be counseled and/or disciplined by the dealer.

Each player is assigned a player position number 18 that corresponds to the replicas 48 in the twelve common betting locations 22, as well as the first and second color bet locations 54, 56. These areas all are located in the bottom half of the betting surface 12. Position numbers 18 and their corresponding replicas 48 eliminate the need for non-value color roulette chips such as those required in the exemplary U.S. Pat. No. 6,520,503 to Porto, as well as similar game play methods. Thus, the use of position numbers 18 and their counterpart replicas 48 removes one of the main features of the game of roulette. As a consequence, the game play method of this invention is substantially distinct from the game of roulette. Game dealers handle only value cheques, which saves the casino from making the investment in non-value chips which are otherwise useful only in a single game. The elimination of non-value color chips allows for quicker payout, faster mucking and more hands per hour. Labor is often the number one expense to a casino. In order to maintain well-paced game speed with the above-referenced Porto game, the casino would need a Mucker to assist the dealer with the color, non-value chips. However, the subject game play method can maintain suitable game play speeds with only one dealer and no Mucker assistant. This represents a huge cost savings to casinos. Furthermore, the risk of mistake or fraud is further reduced by the elimination of non-value color chips.

Preferably, proposition betting areas in the bottom half of the betting surface 12 are laid out in a manner so that players are forced to bet in the location mirroring their assigned player position number 18. Although the illustrated examples show only six player positions 18, more or fewer player positions 18 may be crafted to accommodate larger or smaller groups of players at the table 10. The use of forced betting locations via the replicas 48 eliminates any question as to which player's value cheque is in a particular betting square. The same logic extends to the color bet locations 54, 56. The six possible outcomes 36 of the number "7" (1/6, 6/1, 2/5, 5/2, 3/4, 4/3) are preferably split equally between color bets red and black. In the proposed examples, if the smaller number occurs first or is on top (3/4, 2/5 or 1/6) on the decision determination element (card 20, bingo ball 20', RNG, modified roulette wheel, etc.) the selection is designated as a first color, i.e., red. However, if the larger number occurs first or is on top (4/3, 5/2 or 6/1) then it is designated as a second color bet, i.e., black. This particular arrangement is advantageous in that the low numbers are designated as the first color (i.e., red) and the high numbers are designated as the second color (i.e., black). This particular arrangement is also advantageous because the possible outcomes 36 of the number "7" are a multiple of the required bet. Thus, proposition bets of this invention can achieve acceptable house advantage edges which make them particularly attractive to casinos and other game hosts. Of course, the specific colors red and black are not per se important, merely that they are distinguishable from one another and used consistently.

The similarity of the subject game play method to the traditional games of craps and roulette (both American-style 38 slot and European-style 37 slot games) will be appreciated by those of skill in the art. Nevertheless, the subject game play method proposes many subtle changes that will generate new levels of excitement and interest for players without introducing confusion or disinterest at first impression. For example, no number in traditional roulette is ever representative of more than one color. However, according to this invention, the number 7 can be either Red or Black, thus making the proposition section of this game un-like traditional roulette. Another relevant distinction from the prior art like that described in the above-noted Porto patent arises when a player obtains a 7. According to the prior art, i.e., Porto, the player that obtains a 7 will push all color bets. However, the subject game play includes all of the possible combinations of 7 in the color bets. As a result, it is not necessary to eliminate the six possible occurrences of 7 plus the one or two occurrences of 0 from the color bets as required in the prior art. Instead, according to this invention, only one card or two cards (depending on the number of Joker cards played) are eliminated with respect to color bets. This distinction increases player enjoyment and can be used to craft more suitable odds for the casino.

The game method of this invention utilizes one or two Jokers depending on the casino or house preferring a particular edge or mathematics of game play. If one Joker is used, the payout for the Joker is 35:1. However, if two Jokers are used, the payout for Jokers is reduced to 17:1. Of course, the term "Joker" is used here to indicate a possible point generation outcome that is not included in one of the thirty-six possible outcomes of two six-sided dice.

The casino or game operator can add additional side bets to the game which might require a changed in the composition of the point generation device 14. Naturally, this may require new payouts on the proposition wagers, without departing from the spirit or scope of this invention. The number of chances of hitting any winning combination directly affects the payout of the individual result.

In FIG. 5, value cheques 60 belong to player number "1" and are shown here comprising a proposition placed on the first color bet location 54 associated with player number one. Value cheques 62 are associated with player number "2", and are here shown as a proposition bet placed in the outcome 42 of the common betting location. This is associated with the point generation number "10". Value cheques 64 are associated with player number "3" and are shown having been placed in connection with outcome of the fourth betting location 30 associated with point generation number "4". Value cheques 66 are associated with player number "4" and show a bet placed at the respective second color bet location 56. Value cheques 68 are associated with player number "5" and depict a proposition bet placed in connection with outcome reflecting the number "7". Value cheques 70 relate to player number "6" and represent a large bet placed in connection with outcome of the first common betting location 24.

Figure 7:
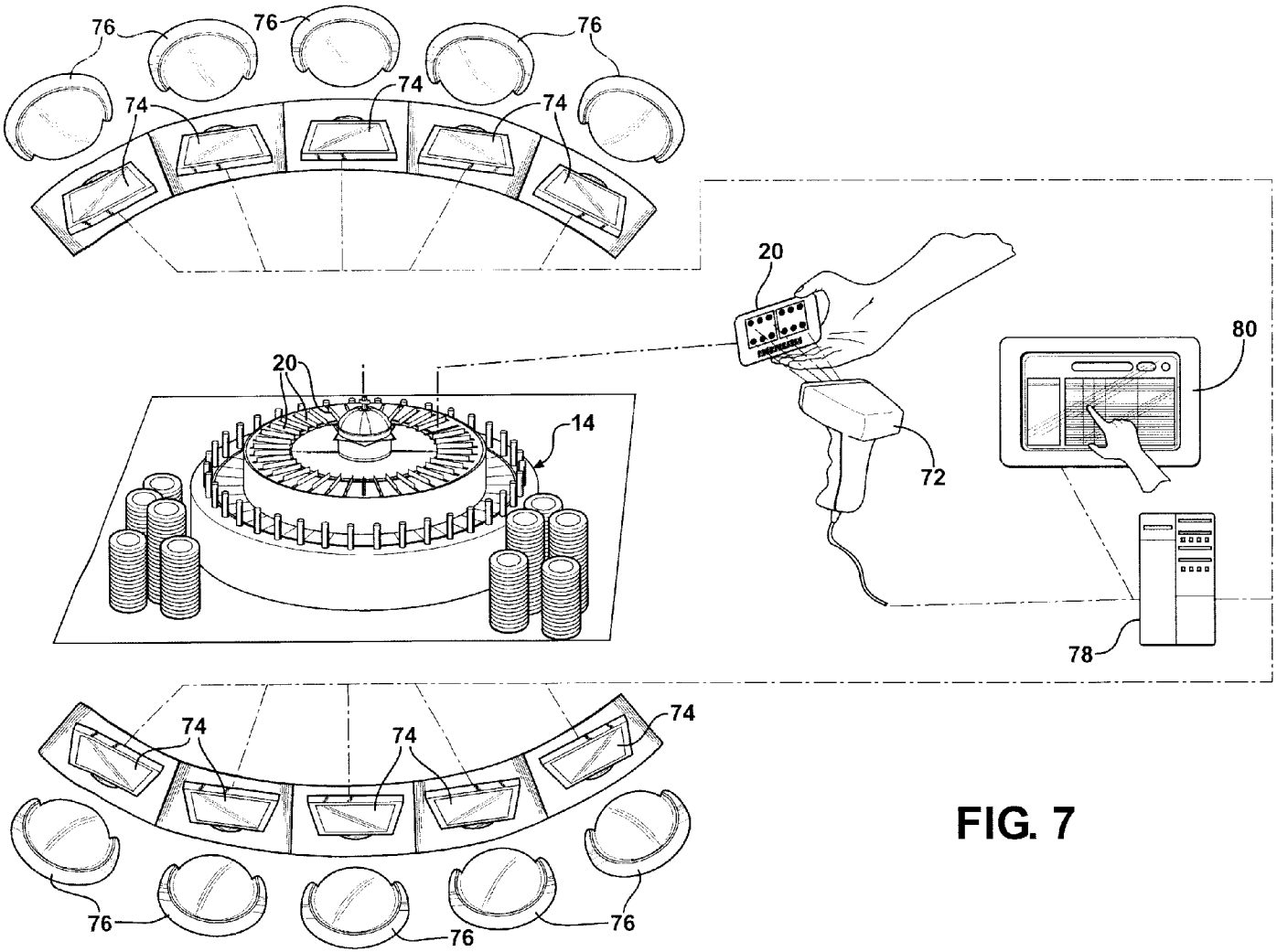
FIG. 7 is a schematic view illustrating play of the subject game method in multi-player video game format.

Of course, in a variation of the game described above, the indicia borne on each card 20, or ball 20', may include a machine-readable code such as, for example, a bar code. A card reading device 72 is shown in FIG. 7. The card reading device 72, here illustrated in the form of a laser scanner, is capable of recognizing the machine readable indicia on the one singulated card 20 and then publishing the identity of the indicia upon one or more video monitors 74. A plurality of such video monitors 74 may be provided in the form of computerized consoles or graphic user interfaces (GUIs) in multi-player mode. These GUIs 74 may be of the touch-screen variety commonly known for the casino games of video poker and the like. It is intended that one GUI 74 would be associated with each individual player of the game of chance. Seats 76 may be arranged directly opposite each GUI 74. In this embodiment, a bet selection region is projected onto the computerized GUIs 74 which may take the graphical appearance of the betting surface 12 as described above. Players make their forecast of the game outcome by associating a virtual marker or token in one of the common betting locations 22 or color bet locations 54, 56. Many GUIs 44 may be operated simultaneously, and each communicates directly or indirectly with a digital processor 78.

At the start of each game, each player wagers according to the game rules and makes a forecast on the game outcome. A dealer places the point generation device 14 into rotation or otherwise operates the device to singulate one outcome from the group consisting of thirty-seven or thirty-eight possible outcomes. This outcome is either announced, or as shown in the illustration, the dealer may pass the one singulated card 20 in view of the scanner 72 causing the digital processor 78 to recognize the outcome and advance play of the game according to the traditional rules of craps. The dealer may be provided with a separate graphical user interface 80 to aid in the administration of the game play and the wagering process.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A method for playing a multi-player table game, said method comprising the steps of:

providing a betting surface;

designating a plurality of player positions spaced about the betting surface, each player position bearing a distinctive player indicia;

prescribing twelve common betting locations on the betting surface, said step of prescribing twelve common betting locations including affixing replicas of each player indicia within the boundaries of each common betting location;

providing a point generation device capable of randomly selecting one outcome from a group consisting of 37 or 38 possible outcomes; said step of providing a point generation device includes supporting a card wheel for rotation about an axis, and removably holding a card in the card wheel corresponding to each outcome;

associating the outcomes with the twelve common betting locations according to the following formula:

at least one outcome is associated with a first of the twelve common betting locations, one outcome is associated with a second of the twelve common betting locations, two outcomes are associated with a third of the twelve common betting locations, three outcomes are associated with a fourth of the twelve common betting locations, four outcomes are associated with a fifth of the twelve common betting locations, five outcomes are associated with a sixth of the twelve common betting locations, six outcomes are associated with a seventh of the twelve common betting locations, five outcomes are associated with an eighth of the twelve common betting locations, four outcomes are associated with a ninth of the twelve common betting locations, three outcomes are associated with a tenth of the twelve common betting locations, two outcomes are associated with an eleventh of the twelve common betting locations, and one outcome is associated with a twelfth of the twelve common betting locations;

permitting players to place at least one betting token directly adjacent the replica of their respective player indicia within the boundary of a common betting location;

activating the point generation device to randomly select one outcome from a group consisting of 37 or 38 possible outcomes; said activating step including forcibly rotating the card wheel about the axis of rotation and then progressively slowing the card wheel to rest and then singulating one of the cards from the card wheel;

announcing the one selected outcome associated with the card singulated from the card wheel; and determining a winner by repeating said activating and announcing steps as needed according to the traditional rules of craps.

2. The method of claim 1 wherein said step of associating the outcomes includes associating exactly one outcome with the first of the twelve common betting locations when the group of outcomes consists of exactly 37 possible outcomes, and associating exactly two outcomes with the first of the twelve common betting locations when the group of outcomes consists of exactly 38 possible outcomes.

3. The method of claim 1 further including the step of exclusively correlating eighteen of the 37 or 38 possible outcomes with a first color, exclusively correlating a different eighteen of the 37 or 38 possible outcomes with a second color, and whereby the remaining 1 or 2 outcomes of the 37 or 38 possible outcomes are correlated with neither the first color nor the second color.

4. The method of claim 3 wherein said step of associating the outcomes includes relating the outcomes associated with the second, third, fourth, fifth and sixth betting locations exclusively to the first color, relating the outcomes associated with the eighth, ninth, tenth, eleventh and twelfth betting locations exclusively to the second color.

5. The method of claim 4 wherein said step of associating the outcomes includes relating half of the outcomes associated with the seventh betting location to the first color and the other half of the outcomes to the second color, and relating the outcomes associated with the first betting location to neither the first color nor the second color.

6. The method of claim 5 wherein thirty-six the 37 or 38 possible outcomes include graphic depictions of each possible combination resulting from the roll of two six-sided die, each die presenting at least one and no more than six non-repeating dots on respective sides thereof, and wherein at least one of the remaining 37 or 38 possible outcomes comprises wild non-die depiction.

7. The method of claim 6 wherein said step of associating the outcomes includes correlating outcomes graphically depicting two six-sided die according to the following arrangement:

the outcome whose sum of dots equal 2 is associated with the second common betting location, the outcomes whose sum of dots equal 3 are associated with the third common betting location, the outcomes whose sum of dots equal 4 are associated with the fourth common betting location, the outcomes whose sum of dots equal 5 are associated with the fifth common betting location, the outcomes whose sum of dots equal 6 are associated with the sixth common betting location, the outcomes whose sum of dots equal 7 are associated with the seventh common betting location, the outcomes whose sum of dots equal 8 are associated with the eighth common betting location, the outcomes whose sum of dots equal 9 are associated with the ninth common betting location, the outcomes whose sum of dots equal 10 are associated with the tenth common betting location, the outcomes whose sum of dots equal 11 are associated with the eleventh common betting location, the outcome whose sum of dots equal 12 is associated with the twelfth common betting location.

8. The method of claim 7 further including the step of displaying on the betting surface a first color bet location and a second color bet location for each player position.

9. The method of claim 1 wherein said step of providing a betting surface includes horizontally supporting a table surface.

10. The method of claim 1 wherein said step of designating a plurality of player positions includes displaying a plurality of numbers arranged sequentially beginning with the number "1."

11. A method for playing a multi-player table game, said method comprising the steps of:

providing a betting surface;

designating a plurality of player positions spaced about the betting surface, each player position bearing a distinctive player indicia;

prescribing twelve common betting locations on the betting surface, said step of prescribing twelve common betting locations including affixing replicas of each player indicia within the boundaries of each common betting location;

providing a point generation device capable of randomly selecting one outcome from a group consisting of 37 or 38 possible outcomes; said step of providing a point generation device includes agitating a plurality of balls in a mixing chamber, each ball corresponding to a different outcome of the point generation device;

associating the outcomes with the twelve common betting locations according to the following formula:

at least one outcome is associated with a first of the twelve common betting locations, one outcome is associated with a second of the twelve common betting locations, two outcomes are associated with a third of the twelve common betting locations, three outcomes are associated with a fourth of the twelve common betting locations, four outcomes are associated with a fifth of the twelve common betting locations, five outcomes are associated with a sixth of the twelve common betting locations, six outcomes are associated with a seventh of the twelve common betting locations, five outcomes are associated with an eighth of the twelve common betting locations, four outcomes are associated with a ninth of the twelve common betting locations, three outcomes are associated with a tenth of the twelve common betting locations, two outcomes are associated with an eleventh of the twelve common betting locations, and one outcome is associated with a twelfth of the twelve common betting locations;

permitting players to place at least one betting token directly adjacent the replica of their respective player indicia within the boundary of a common betting location;

activating the point generation device to randomly select one outcome from a group consisting of 37 or 38 possible outcomes; said activating step including forcibly agitating the plurality of balls in the mixing chamber and then randomly singulating one of the balls from the mixing chamber;

announcing the one selected outcome associated with the ball singulated from the mixing chamber; and determining a winner by repeating said activating and announcing steps as needed according to the traditional rules of craps.

12. The method of claim 11 wherein said step of associating the outcomes includes associating exactly one outcome with the first of the twelve common betting locations when the group of outcomes consists of exactly 37 possible outcomes, and associating exactly two outcomes with the first of the twelve common betting locations when the group of outcomes consists of exactly 38 possible outcomes.

13. The method of claim 11 further including the step of exclusively correlating eighteen of the 37 or 38 possible outcomes with a first color, exclusively correlating a different eighteen of the 37 or 38 possible outcomes with a second color, and whereby the remaining 1 or 2 outcomes of the 37 or 38 possible outcomes are correlated with neither the first color nor the second color.

14. The method of claim 13 wherein said step of associating the outcomes includes relating the outcomes associated with the second, third, fourth, fifth and sixth betting locations exclusively to the first color, relating the outcomes associated with the eighth, ninth, tenth, eleventh and twelfth betting locations exclusively to the second color.

15. The method of claim 14 wherein said step of associating the outcomes includes relating half of the outcomes associated with the seventh betting location to the first color and the other half of the outcomes to the second color, and relating the outcomes associated with the first betting location to neither the first color nor the second color.

16. The method of claim 15 wherein thirty-six the 37 or 38 possible outcomes include graphic depictions of each possible combination resulting from the roll of two six-sided die, each die presenting at least one and no more than six non-repeating dots on respective sides thereof, and wherein at least one of the remaining 37 or 38 possible outcomes comprises wild non-die depiction.

17. The method of claim 16 wherein said step of associating the outcomes includes correlating outcomes graphically depicting two six-sided die according to the following arrangement:

the outcome whose sum of dots equal 2 is associated with the second common betting location, the outcomes whose sum of dots equal 3 are associated with the third common betting location, the outcomes whose sum of dots equal 4 are associated with the fourth common betting location, the outcomes whose sum of dots equal 5 are associated with the fifth common betting location, the outcomes whose sum of dots equal 6 are associated with the sixth common betting location, the outcomes whose sum of dots equal 7 are associated with the seventh common betting location, the outcomes whose sum of dots equal 8 are associated with the eighth common betting location, the outcomes whose sum of dots equal 9 are associated with the ninth common betting location, the outcomes whose sum of dots equal 10 are associated with the tenth common betting location, the outcomes whose sum of dots equal 11 are associated with the eleventh common betting location, the outcome whose sum of dots equal 12 is associated with the twelfth common betting location.

18. The method of claim 17 further including the step of displaying on the betting surface a first color bet location and a second color bet location for each player position.

19. The method of claim 11 wherein said step of providing a betting surface includes horizontally supporting a table surface.

20. A method for playing a multi-player table game, said method comprising the steps of:

providing a playing surface on a generally horizontally supporting structure;

providing a craps betting surface on the horizontally supporting structure;

designating a plurality of player positions spaced about the craps betting surface;

prescribing at least twelve common betting locations on the craps betting surface, said step of prescribing twelve common betting locations including providing an area within the boundary of each common betting location where the plurality of players can place wagers;

providing a point generation device adjacent the craps betting surface that is capable of randomly selecting one outcome from a group consisting of 37 or 38 possible outcomes, said step of providing a point generation device includes supporting a card wheel for rotation about an axis and removably holding a card in the card wheel corresponding to each outcome;

associating the outcomes with the at least twelve common betting locations according to the following formula:

at least one outcome is associated with a first of the twelve common betting locations, one outcome is associated with a second of the twelve common betting locations, two outcomes are associated with a third of the twelve common betting locations, three outcomes are associated with a fourth of the twelve common betting locations, four outcomes are associated with a fifth of the twelve common betting locations, five outcomes are associated with a sixth of the twelve common betting locations, six outcomes are associated with a seventh of the twelve common betting locations, five outcomes are associated with an eighth of the twelve common betting locations, four outcomes are associated with a ninth of the twelve common betting locations, three outcomes are associated with a tenth of the twelve common betting locations, two outcomes are associated with an eleventh of the twelve common betting locations, and one outcome is associated with a twelfth of the twelve common betting locations;

allowing for the placement of wagers by each of the plurality of players within the boundary of at least one of the common betting locations;

activating the point generation device to randomly select one outcome from a group consisting of 37 or 38 possible outcomes, said activating step including rotating the card wheel about the axis of rotation and then progressively slowing the card wheel to rest and then selecting one of the cards from the card wheel;

announcing the one selected outcome associated with the number generated from the point generation device;

settling wagers based the one selected outcome; and repeating said activating and announcing steps as needed according to the traditional rules of craps.

* * * * *